US011103080B2

(12) United States Patent
Reale

(10) Patent No.: US 11,103,080 B2
(45) Date of Patent: Aug. 31, 2021

(54) BLANKET ELEVATING DEVICE

(71) Applicant: Joseph Reale, East Northport, NY (US)

(72) Inventor: Joseph Reale, East Northport, NY (US)

( * ) Notice: Subject to any disclaimer, the term of this patent is extended or adjusted under 35 U.S.C. 154(b) by 56 days.

(21) Appl. No.: 16/182,872

(22) Filed: Nov. 7, 2018

(65) Prior Publication Data

US 2019/0231080 A1 Aug. 1, 2019

Related U.S. Application Data

(60) Provisional application No. 62/586,945, filed on Nov. 16, 2017.

(51) Int. Cl.
*A47C 21/02* (2006.01)
*A61G 7/05* (2006.01)

(52) U.S. Cl.
CPC ..... *A47C 21/024* (2013.01); *A61G 7/0501* (2013.01)

(58) Field of Classification Search
CPC ..... A61G 7/0501; A47C 21/024
See application file for complete search history.

(56) References Cited

U.S. PATENT DOCUMENTS 2,106,834 A * 2/1938 Ewald ..... A47C 21/024 5/505.1
D149,816 S * 6/1948 Ivelow ..... D6/681.1
2,598,295 A * 5/1952 Pelton ..... A47C 21/024 5/505.1
2,602,171 A * 7/1952 Good ..... A47C 21/024 5/505.1
3,317,932 A * 5/1967 Gibbons, Sr. ..... A47C 21/024 5/505.1
5,329,658 A * 7/1994 Fontenot ..... A47C 21/024 5/504.1
6,834,403 B1 * 12/2004 Elliott ..... A61G 7/0501 5/426
6,935,992 B2 * 8/2005 Gehrke ..... A47C 20/021 482/100
7,137,159 B1 * 11/2006 Choate ..... A47C 21/024 5/505.1
D637,015 S * 5/2011 Rogers ..... D6/681
D649,378 S * 11/2011 Rogers ..... D6/708.16
D690,541 S * 10/2013 Rogers ..... D6/675.5
D738,144 S * 9/2015 Rogers ..... D6/675.5
2006/0248647 A1 * 11/2006 Huber ..... A61G 7/0501 5/505.1
2008/0295247 A1 * 12/2008 Rogers ..... A47C 21/024 5/505.1
2009/0056019 A1 * 3/2009 Alston ..... A47C 21/024 5/498
2009/0235455 A1 * 9/2009 Strickland ..... A47C 21/024 5/505.1
2015/0238019 A1 * 8/2015 Farahani ..... A47C 21/024 5/690

* cited by examiner

*Primary Examiner* — Eric J Kurilla
(74) *Attorney, Agent, or Firm* — Hoffmann & Baron, LLP

(57) ABSTRACT

Provided herein is a blanket elevating device, including a telescoping spinal handle assembly, a structural support portion attached to the telescoping spinal handle assembly, the structural support portion for elevating a blanket above a surface of a bed; and an anchor portion connected to the telescoping spinal handle assembly, wherein the blanket elevating device is actuatable between a collapsed position and an expanded position by the telescoping handle assembly.

8 Claims, 4 Drawing Sheets

BLANKET ELEVATING DEVICE

CROSS-REFERENCE TO RELATED APPLICATIONS

This application claims priority from U.S. Provisional Application No. 62/586,945, filed Nov. 16, 2017, herein incorporated by reference in its entirety.

FIELD OF THE INVENTION

The present invention relates generally to blanket elevating device for use by a person to elevate a blanket over a bed while still maintaining the blanket over the person, but not contacting the person's skin.

BACKGROUND OF INVENTION

There are a number of reasons why a person may need a blanket elevated over, but not touching their body. Hospitals, for example, have many patients which may need a device that elevates bed covers from resting against the feet of the patient. For some, the weight of the bedding aggravates suffering due to common foot ailments. Burn victims, for example, cannot have even the lightest of coverings touching their skin without extreme pain. For others, including those that share their bed with their beloved domesticated pet such as a dog or cat, there is a desire to provide ample air space and room for the pet to burrow comfortably yet maintain the cover over the lower extremity of the human user.

There are ample attempts to provide a device for elevating covers from an occupant's feet. One device is described in U.S. Pat. No. 6,834,403 issued to Elliot on Dec. 28, 2004, and discloses a tubular frame member adapted to insert between a top mattress and box spring common to modern beds. Elliot teaches a rigid, non-folding frame having a width of the substantially less than the width of the mattress and must be inserted under the end of the mattress and its use is limited to one occupant of the bed. The rigid frame does not collapse into a compact shape suitable for shipping, transportation or storage and moreover, the Elliot device does not self-assemble from a collapsed position using an internal elastic member.

Another attempt to provide an improved support device for bedding includes the "Bedclothes Support Assembly" of Choate disclosed in U.S. Pat. No. 7,137,159 issued on Nov. 21, 2006. Therein a series of tubular segments coupled by rounded elbows link together to form a frame having a pair of vertical arms supporting a horizontal member and a C-shaped base. One short coming of the Choate device is a lack of self-assembly means and an overly cumbersome base portion to provide sufficient stability for the upper horizontal member. It would be beneficial to have a simpler design with fewer components and arranging the components in a manner with means for self-assembly.

A simpler approach, a "Blanket Support Assembly" by Warrington et al. disclosed in U.S. Pat. No. 6,901,616 includes two vertical arms connecting a single horizontal member. However the arms require a support mechanism that is anchored to the bed frame. When not in use, Warrington teaches rotating the horizontal member and linking arms to the foot of the bed. This approach does not disassemble when not in use, does not fold to a compact size for storage or shipping, and must be coupled to a bed frame for structural rigidity. Therefore, it would be beneficial to have an improved structure that could be taken apart for storage and shipping and further, not require mechanical coupling to a bed frame for the required rigidity.

Yet another representative cover support for a bed includes the disclosure of Dilascio in U.S. Pat. No. 6,895,615 issued on May 24, 2005. Dilascio discloses a segmented horizontal arm coupled to a pair of vertical uprights, each upright inserting into a sleeve, the sleeve mounted to an inverted U-shaped plate and a flat, elongated member connecting the two inverted u-shaped plates. This design does not self-assemble and requires the mattress weight to retain its upright stance. Therefore, it would be beneficial for an improved structure to be self-standing.

Despite attempts in the art to provide an easy to use device suitable for use to elevate blanket or covers, there remains a need for an improved blanket elevating device including a frame which is easy to use, lightweight, and adaptable for use with a myriad of bed widths and heights and for different sized users. It would be desirable to have a self-assembling frame support that is both light-weight, yet rigid, and includes an grip handle which would make use and transport of the device more simple and efficient.

SUMMARY OF THE INVENTION

The present invention therefore provides a blanket elevating device. The blanket elevating device includes i) a telescoping spinal handle assembly; ii) a structural support portion attached to the telescoping spinal handle assembly, the structural support portion for elevating a blanket above a surface of a bed; and iii) an anchor portion connected to the telescoping spinal handle assembly, wherein the blanket elevating device is actuatable between a collapsed position and an expanded position by the telescoping handle assembly.

In an embodiment, the telescoping spinal handle assembly of the blanket elevating device includes i) at least one pair of channels arranged in parallel orientation with each other; and ii) at least one pair of inserts arranged in parallel orientation with each other, which are slidably engaged within the channels, wherein the telescoping handle assembly has an upper portion having a handle grip and the channels and the inserts each have mated latching means for locking the channels and inserts in a collapsed position or an extended position.

In another embodiment, the latching means of the blanket elevating device is a push button locking system. In an embodiment, the structural support portion and the anchor portion are scaffolds extending horizontally with respect to the vertically oriented telescoping spinal handle assembly. In an embodiment, the anchor portion is positioned under a mattress to support the blanket elevating device in working engagement with a bed.

In yet another embodiment, the structural support of the blanket elevating device includes two horizontally projecting bars or brackets attached to the telescoping spinal handle, and the anchor portion includes two horizontally projecting bars or brackets, also attached to the telescoping spinal handle, the structural support portion and the anchor portion being in parallel orientation with each other.

In another embodiment, the present invention includes a method of making a blanket elevating device. The method of making includes i) assembling a telescoping spinal handle assembly; ii) appending a structural support portion to the telescoping spinal handle assembly; and iii) appending an anchor portion to the telescoping spinal handle assembly, wherein the blanket elevating device is actuatable between a collapsed position and an expanded position by the telescoping handle assembly.

In another embodiment, a method of using a blanket elevating device to elevate a blanket over a bed is also provided herein. The method includes: i) placing a blanket elevating device of on a bed such that an anchor portion secures the blanket elevating device under a mattress of the bed; and ii) extending a telescoping spinal handle assembly to an activated position such that a structural support portion provides a scaffold for elevating a blanket over the bed.

DETAILED DESCRIPTION OF THE INVENTION

The present invention is directed to a blanket elevating device which uses a support structure to elevate a blanket off of a bed so that the blanket does not come in contact with a body of a person positioned in the bed. The blanket elevating device is easily collapsible and transportable, using a telescoping spinal assembly which can be retracted to a compact position.

Figure 1:
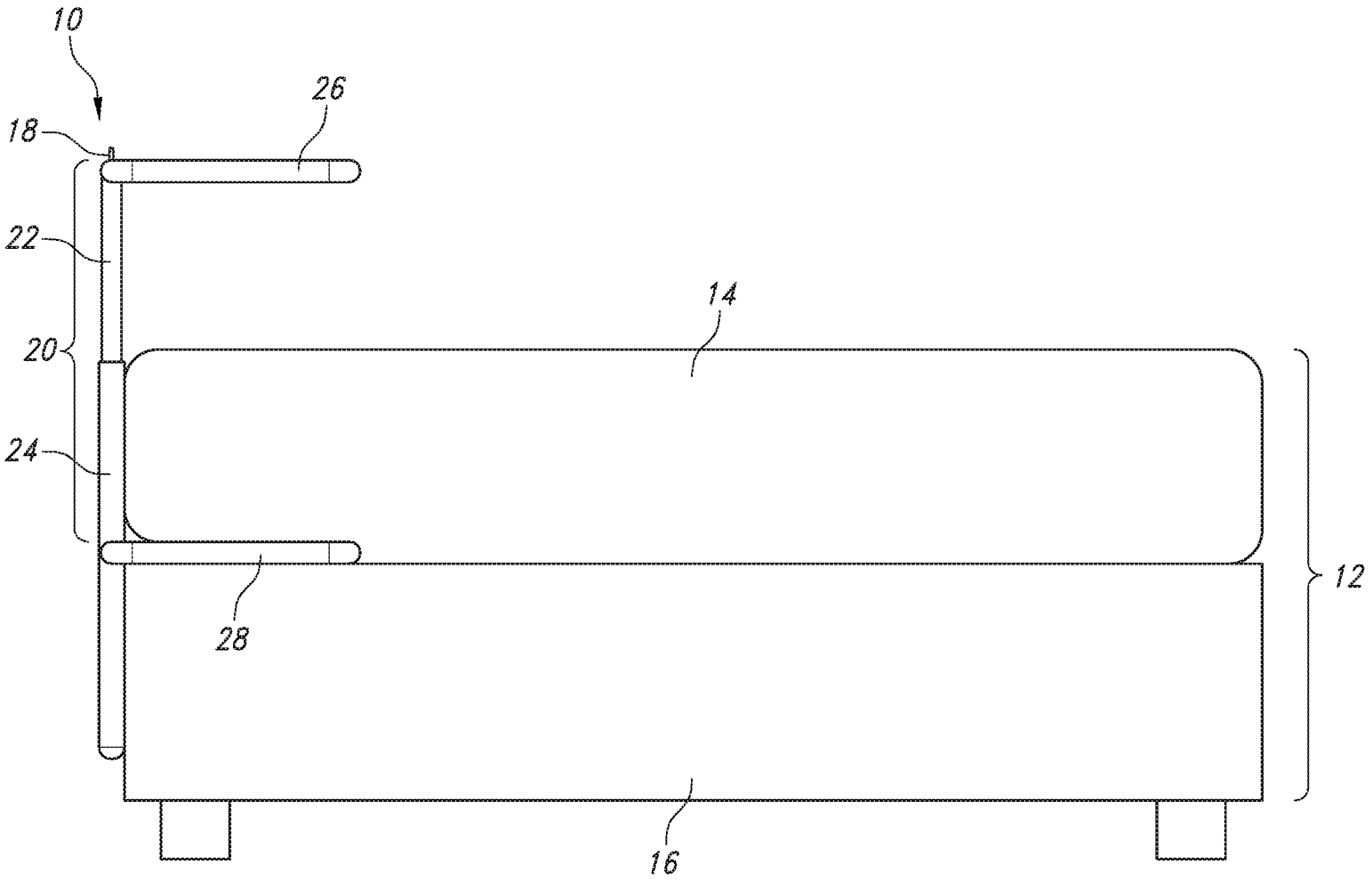
FIG. 1 shows a blanket elevating device of the present invention in use on a bed.

With reference now to the drawings, FIG. 1 shows a side view of a blanket elevating device 10 positioned in use on a bed 12. The bed includes a mattress 14 positioned on top of a box spring 16. Blanket elevating device 10 includes a handle grip 18 positioned at the top of telescoping spinal handle assembly 20. Spinal handle assembly 20 includes at least one pair of inserts 22, which are slidably engaged within at least one pair of channels 24. Only 1 of the at least one pair of inserts 22 can be seen in FIG. 1 because FIG. 1 shows a side perspective view of device 10 where a second insert of the pair is hidden from view. Only 1 of the at least one pair of channels 24 can be seen in FIG. 1 because FIG. 1 shows a side perspective view of device 10 where a second channel of the pair is hidden from view. Inserts 22 and channels 24 have a mated cross-section to ensure easy motion of inserts 22 in and out of channels 24. The cross-section of inserts 22 and channels 24 can be tubular or rectangular, for example. If the inserts 22 and channels 24 are tubular, for example, inserts 22 have diameter less than the diameter of channels 24 to insure inserts therein.

Structural support 26 is also shown in FIG. 1, and is horizontally oriented with regard to a vertically oriented spinal handle assembly 20. Structural support 26 is designed to support a blanket over, but not in contact with a person in bed 12, so that the person can have a blanket on them for warmth, but not touching a part of the body over which the blanket is elevated. This is particularly useful for a person with a medical or skin condition, for example, that the blanket might irritate if it came in contact with the person's body. Anchor portion 28 is also shown in FIG. 1, and is horizontally oriented with regard to a vertically oriented spinal handle assembly 20. Anchor portion 28 and structural support 26 are both substantially horizontally oriented with regard to spinal handle assembly 20. Anchor portion 28 is designed to be inserted under mattress 14 of bed 12 such that the weight of mattress 12 (and the person in the bed) holds device 10 in stable position; e.g. where the spinal handle assembly 20 is positioned such that structural support 26 can properly support a blanket off of bed 12.

Figure 2:
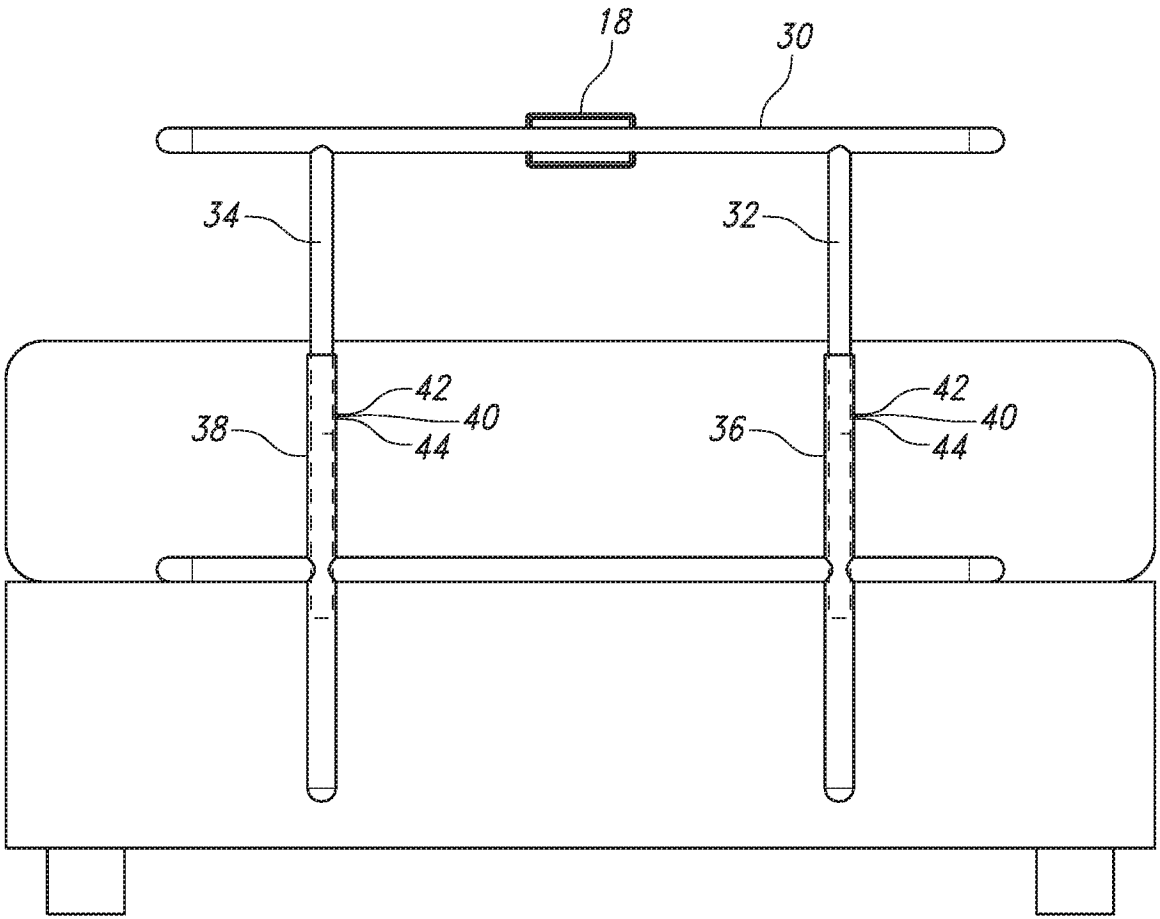
FIG. 2 shows a blanket elevating device of the present invention from a different perspective view.

With reference to FIG. 2 of the drawings, blanket elevating device 10 is viewed from a different perspective; e.g., viewed as looking up from the foot of the bed as assembled on the foot of bed 12. Grip 18 is shown as part of upper portion 30 of spinal handle assembly 20. Upper portion 30 is a bar which is perpendicularly attached to two inserts 32 and 34. Structural support portion 26 (not shown in FIG. 2) projects outward from upper portion 30 over bed 12, but cannot be viewed from this perspective. Inserts 32 and 34 are slidably engaged in channels 36 and 38. While one pair of inserts and channels are shown in the figures, it is understood that telescoping spinal handle assembly 20 can include further inserts and/or channels in the assembly. A channel can also act as an insert, and an insert can also act as a channel in such an assembly with multiple channels and inserts.

The present invention is illustrated with a pair of parellelly oriented inserts 32 and 34 and channels 36 and 38, but it is also contemplated within the present invention that a single insert and channel may us instead of a pair of parallel oriented inserts and channels. Telescoping spinal handle assembly 20 further includes a latching means 40 to secure spinal handle assembly in either an extended, operational configuration, or a compact configuration. The spinal handle assembly retracts and extends similar to a luggage handle, and may be operated by a multitude of different mechanisms well known to one of skill in the art. For example, the latching means may utilize a frictional coupling between each of the adjacent sections of each insert and channel, which provides for ease of operation. Each coupling is between a pair of cylindrical or rectangular sections having a common longitudinal axes. The intersection is adapted to be received within the cavity of the larger channel. At the coupling, the terminus of the larger section is flared inwardly, the diameter of the flared terminus of the larger section approximating the outer diameter of the smaller section. The terminus of the smaller insert section flares outwardly within the cavity formed by the larger section and is adapted to slidingly engage the inner surface of the larger section. A frictional engagement is used to maintain the position of the coupled section irrespective of whether the sections are fully extended or in the collapsed position. A push button system may be used where a loaded button 42 is released in a cavity 44 of channels 38 and 36 to lock button 44 in place. The latching means may be actuatable by pressing button 42 directly or may be actuatable by a trigger in grip 18.

Figure 3:
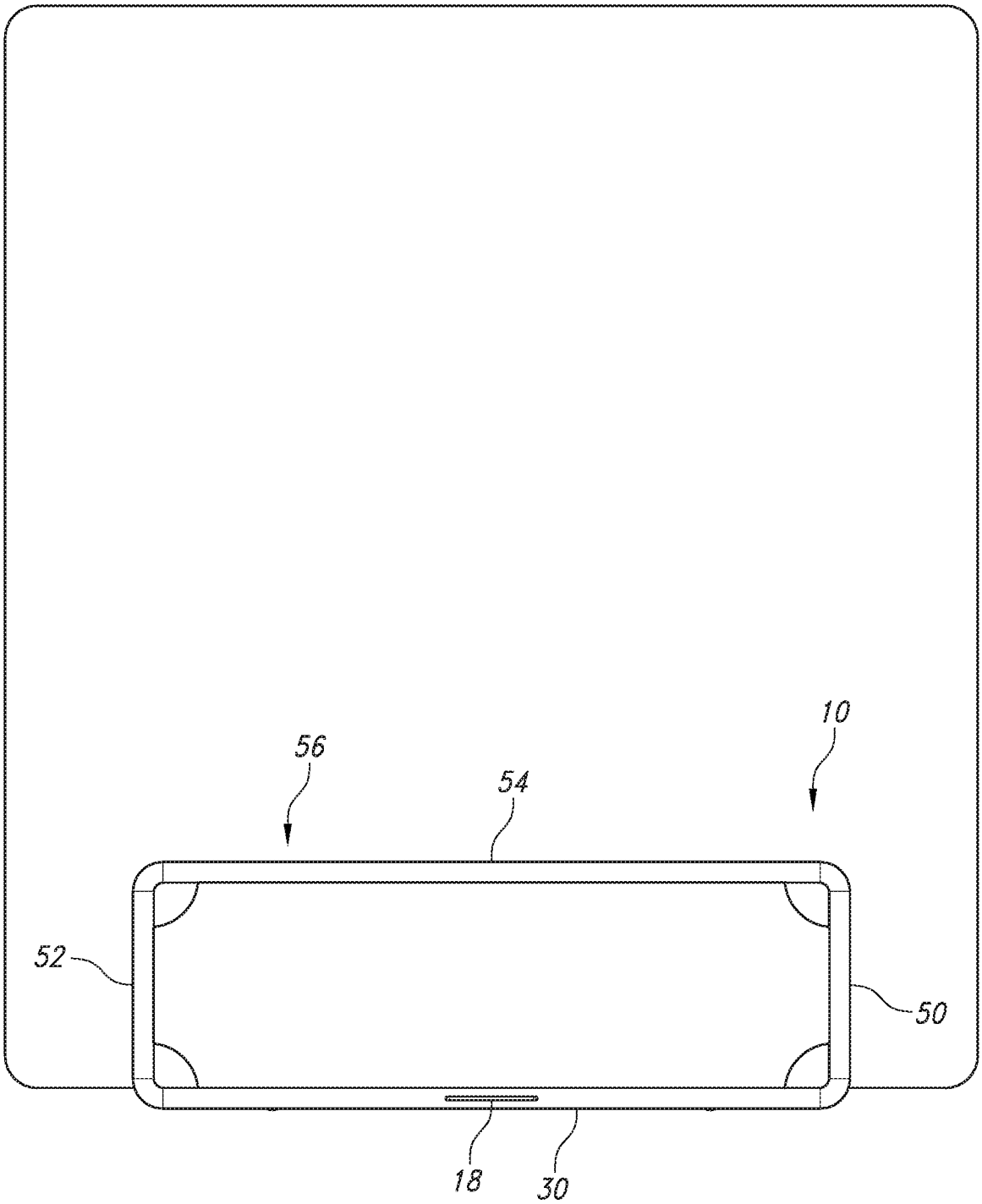
FIG. 3 shows a top view of a blanket elevating device of the present invention.
Figure 4:
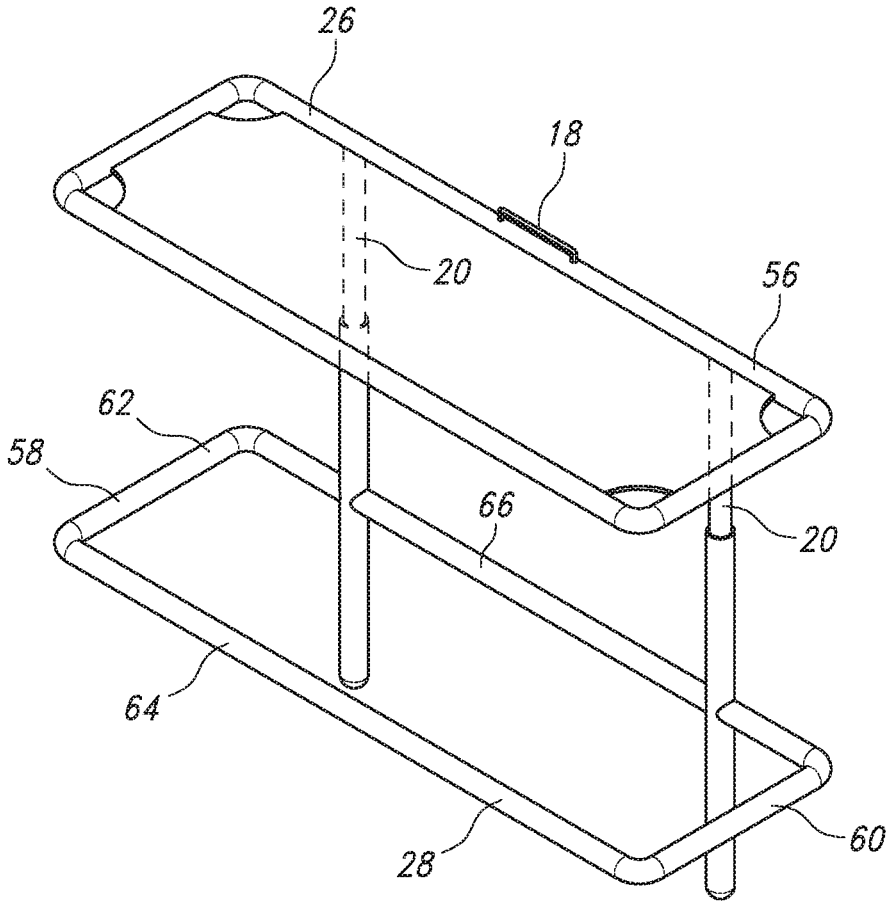
FIG. 4 shows another side view of a blanket elevating device of the present invention.

Referring now to FIG. 3 of the drawings, a view of blanket elevating device 10 from a top view perspective is shown. Structural support portion 26 is shown, and includes horizontally projecting arms 50 and 52 extending from spinal handle assembly 20. In the embodiment shown in FIG. 3, arms 50 and 52 are connected to form a rectangle 56 by crossbar 54 and upper portion 30 of spinal handle assembly 20. With reference now to FIG. 4 of the drawings, another side view of blanket elevating device 10 is shown. Structural support portion 26 is shown as a rectangular shape 56, connected by spinal assembly 20 to anchor portion 28, which is also shown as a rectangular shaped structure 58. Anchor portion 28 includes horizontally projecting arms 60 and 62 extending from spinal handle assembly 20. In the embodiment shown in FIG. 4, arms 60 and 62 are connected to form a rectangle 58 by crossbar 64 and mated crossbar 66.

Thus while there have been described what are presently believed to be preferred embodiments of the invention, those skilled in the art will realize that changes and modifications may be made thereto without departing from the spirit of the invention, and it is intended to claim all such changes and modifications as fall within the true scope of the invention.

What is claimed is:

1. A blanket elevating device, said blanket elevating device comprising:

i) a telescoping spinal handle assembly, said telescoping spinal handle assembly comprising at least one pair of channels arranged in parallel orientation with each other; and at least one pair of inserts arranged in parallel orientation with each other, said at least one pair of inserts are slidably engaged within said at least one pair of channels, wherein said telescoping handle assembly has an upper portion having a handle grip and said at least one pair of channels and said at least one pair of inserts each have mated latching means for locking said channels and inserts in a collapsed position or an extended position, said latching means actuatable by a trigger in said handle grip;

ii) a structural support portion attached to said telescoping spinal handle assembly, said structural support portion for elevating a blanket above a surface of a bed; and iii) an anchor portion connected to said telescoping spinal handle assembly, wherein said blanket elevating device is actuatable between a collapsed position and an expanded position by said telescoping handle assembly.

2. The blanket elevating device of claim 1 wherein said latching means is a push button locking system.

3. The blanket elevating device of claim 1 wherein said structural support portion and said anchor portion are scaffolds extending horizontally with respect to the vertically oriented telescoping spinal handle assembly.

4. The blanked elevating device of claim 3 wherein said anchor portion is positioned under a mattress to support said blanket elevating device in working engagement with a bed.

5. The blanket elevating device of claim 3 wherein said structural support portion comprises 2 horizontally projecting bars or brackets attached to said telescoping spinal handle, and said anchor portion comprises 2 horizontally projecting bars or brackets also attached to said telescoping spinal handle, said structural support portion and said anchor portion being in parallel orientation with each other.

6. A method of making a blanket elevating device comprising:

i) assembling a telescoping spinal handle assembly, said telescoping spinal handle assembly including at least one pair of channels arranged in parallel orientation with each other, and at least one pair of inserts arranged in parallel orientation with each other, said at least one pair of inserts are slidably engaged within said at least one pair of channels, wherein said telescoping handle assembly has an upper portion having a handle grip and said at least one pair of channels and said at least one pair of inserts each have mated latching means for locking said channels and inserts in a collapsed position or an extended position, said latching means actuatable by a trigger in said handle grip;

ii) appending a structural support portion to said telescoping spinal handle assembly; and iii) appending an anchor portion to said telescoping spinal handle assembly, wherein said blanket elevating device is actuatable between a collapsed position and an expanded position by said telescoping handle assembly.

7. A method of using a blanket elevating device to elevate a blanket over a bed comprising:

i) placing a blanket elevating device of claim 1 on a bed such that an anchor portion secures said blanket elevating device under a mattress of said bed; and ii) extending a telescoping spinal handle assembly to an activated position such that a structural support portion provides a scaffold for elevating a blanket over said bed.

8. A blanket elevating device, said blanket elevating device comprising:

i) a telescoping spinal handle assembly, said telescoping spinal handle assembly comprising at least one pair of channels arranged in parallel orientation with each other; and at least one pair of inserts arranged in parallel orientation with each other, said at least one pair of inserts are slidably engaged within said at least one pair of channels, wherein said telescoping handle assembly has an upper portion having a handle grip and said at least one pair of channels and said at least one pair of inserts each have mated latching devices including a movable button for locking said channels and inserts in a collapsed position or an extended position, said button being actuatable by a trigger in said handle grip;

ii) a structural support portion attached to said telescoping spinal handle assembly, said structural support portion for elevating a blanket above a surface of a bed; and iii) an anchor portion connected to said telescoping spinal handle assembly, wherein said blanket elevating device is actuatable between a collapsed position and an expanded position by said telescoping handle assembly.

* * * * *